United States Patent [19]

Miller

[11] Patent Number: 4,510,362

[45] Date of Patent: Apr. 9, 1985

[54] MICROWAVE OVEN RACK DESIGN

[75] Inventor: Matthew S. Miller, Louisville, Ky.

[73] Assignee: General Electric Company, Louisville, Ky.

[21] Appl. No.: 612,143

[22] Filed: May 21, 1984

[51] Int. Cl.[3] ..... H05B 6/64

[52] U.S. Cl. ..... 219/10.55 E; 126/337 R; 312/300; 99/449

[58] Field of Search ..... 219/10.55 E, 10.55 R, 219/10.55 F, 392; 99/448, 449, 340; 126/337 R, 334, 337 A, 333; 312/248, 300; D21/251; 248/242, 240.4, 371; 211/168; 108/1, 32

[56] References Cited

U.S. PATENT DOCUMENTS

| | | | |
|---|---|---|---|
| D. 220115 | 3/1971 | Semler | D21/251 |
| 2,465,806 | 3/1949 | Jewell | 126/337 R |
| 2,549,709 | 4/1951 | Potts | 99/449 |
| 2,875,016 | 2/1959 | Fry | 126/337 R |
| 3,152,536 | 10/1964 | Lucas | 248/371 |
| 3,169,520 | 2/1965 | Smith et al. | 126/338 |
| 3,489,136 | 1/1970 | Bucellato | 126/337 |
| 3,691,937 | 9/1972 | Meek et al. | 99/340 |
| 4,048,984 | 9/1977 | Eberhardt | 126/337 R |
| 4,271,344 | 6/1981 | Horiuchi et al. | 219/10.55 E |
| 4,434,344 | 2/1984 | Dills | 219/10.55 E |

FOREIGN PATENT DOCUMENTS

| | | | |
|---|---|---|---|
| 3040113 | 5/1982 | Fed. Rep. of Germany | 219/10.55 E |

*Primary Examiner*—Roy N. Envall, Jr.
*Assistant Examiner*—M. M. Lateef
*Attorney, Agent, or Firm*—Frank P. Giacalone; Radford M. Reams

[57] ABSTRACT

A wire rack construction designed to be used in a microwave oven in spaced relationship with the flat bottom wall of the oven. The wire rack is provided with upwardly and downwardly projections which are arranged such that when the rack is placed on the flat bottom wall of the oven the rack will tilt at a steep angle to thereby discourage its use in the oven when it is not arranged in its design position relative to the bottom wall.

14 Claims, 6 Drawing Figures

MICROWAVE OVEN RACK DESIGN

BACKGROUND OF THE INVENTION

This invention relates to microwave ovens and more particularly to a microwave oven wherein a removable meal supporting rack is provided. It is common in microwave ovens to provide a rack system wherein food to be cooked may be arranged at different levels in the oven cavity. Generally, these systems incorporate removable racks that can be selectively placed in the cavity at different levels. When metal racks are used they may absorb a substantial amount of wave energy supplied to the oven and also may distort the electric and magnetic field patterns so as to cause uneven cooking. Metal racks must therefore be designed and located in the oven cavity relative to the conductive path length and operating microwave frequency of the oven so as to not distort the cooking pattern or induce arcing at the walls of the oven. Generally the rack must be removed from its designated position in the oven whenever the food to be cooked is of a size and shape that would cause the rack to interfere with the placement of the food in the oven. Often the user of the rack, rather than remove and store the rack, will place the rack on the bottom wall of the oven and place the food to be cooked on the rack. The placement of the rack in an undesignated position relative to the conductive path length and operating microwave frequency of the oven can cause arcing of the rack to the cavity walls and overheating in the oven which in some instances potentially creates cavity fires.

By this invention there is provided a rack arrangement for microwave ovens in which use of the rack is discouraged in an undesignated area of the oven and must be removed from the oven for storing when not in use.

SUMMARY OF THE INVENTION

An object of the present invention is to provide a wire rack which is designed such that when placed on a flat surface such as the bottom wall of the oven the rack is oriented at an angle such as to discourage its use.

The present invention relates to a microwave oven cooking rack construction adapted to be supported in a microwave oven in a spaced relationship relative to the bottom wall of the oven. The rack includes a support surface defining a plane which is supported on front, rear and side edge portions. The side walls of the oven are provided with fore and aft extending supports on which the side edge portions of the rack are seatable. The side edge portions of the rack are formed to include indexing means for engaging the extending supports on the side walls for positioning the rack relative to the oven walls.

Further, each of the side edges is provided with a pair of projections, one of each pair of projections extends upwardly and the other one of each pair of projections extends downwardly relative to the plane of the rack. The one of each pair of the projections is positioned forwardly and the other one of each pair of projections is positioned rearwardly of a line dividing the rack between a fore and aft position. Accordingly in the event the rack is placed on the bottom wall of the oven either the one or the other one of each pair of projections will contact the bottom wall and cause the rack to pivot thereabout so that the support surface defined by the plane will lay at an angle relative to the substantially horizontal bottom wall of the oven to thereby prevent inadvertent use of the rack when it is positioned on the bottom wall of the oven.

BRIEF DESCRIPTION OF THE INVENTION

Figure 1:
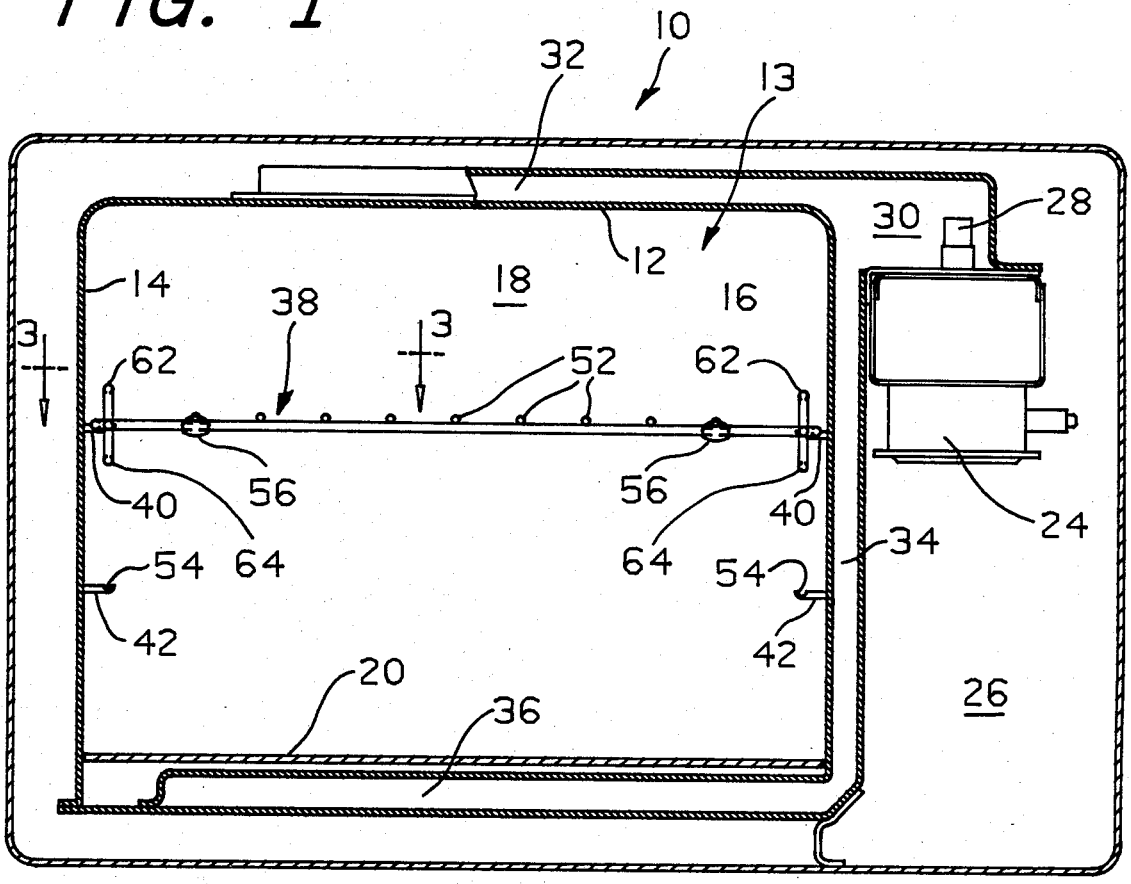
FIG. 1 is a front elevational view in section incorporating the oven rack system of the present invention.
Figure 2:
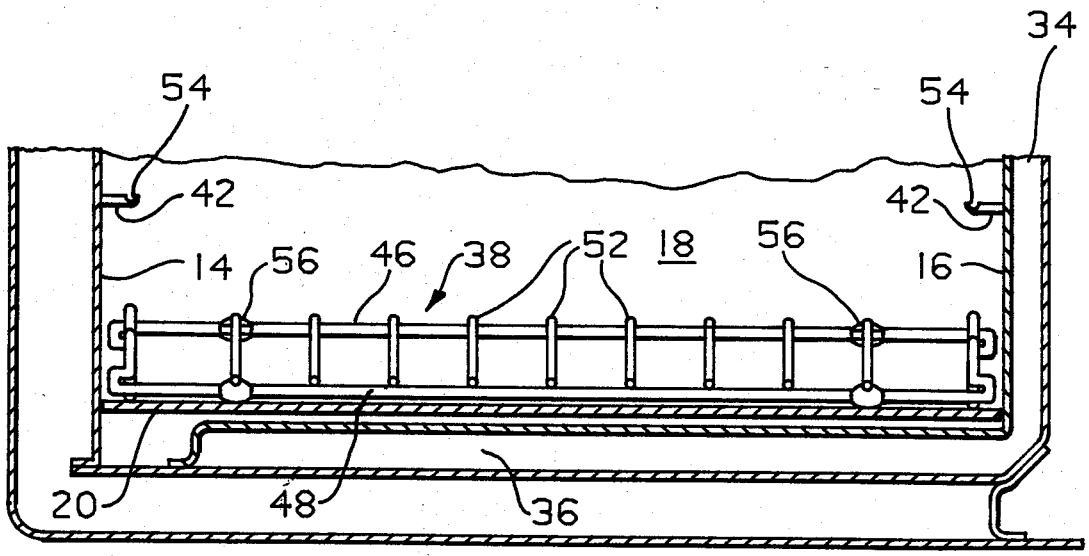
FIG. 2 is a fragmentary front elevational view in section showing the present rack system arranged in an undesignated portion of the oven.

Referring to FIGS. 1 and 2 of the drawing the numeral 10 generally designates a microwave oven having a front opening and generally rectangular metallic walls forming an oven compartment 13 including a top wall 12, side walls 14 and 16, rear wall 18, and a bottom wall 20. The front wall of the oven is formed by a door 22 mounted so as to be pivoted from an open position to a closed position.

The source of microwave energy for oven 13 is a magnetron 24 which is mounted in a control compartment 26. Magnetron 24 has its output probe 28 positioned in a launch area 30. It will be understood that numerous other components are required to complete a microwave oven, but for clarity of illustration and description, only those elements believed essential for a proper understanding relative to the present invention are shown and described.

Microwave energy is fed from magnetron 24 to oven 13 through a coupling or transmission means such as a waveguide having a horizontally extending top branch or section 32, a vertically oriented side branch or section 34, and a horizontally extending bottom branch or section 36. Microwave energy from launch area 30 in the vicinity of probe 28 of magnetron 24 is split between waveguide 32 and waveguide 34.

The microwave oven so far described, including the combination of upper and lower waveguide configuration, is fully disclosed in U.S. Pat. No. 4,354,083-Staats, assigned to the General Electric Company, the assignee of the present invention.

Figure 6:
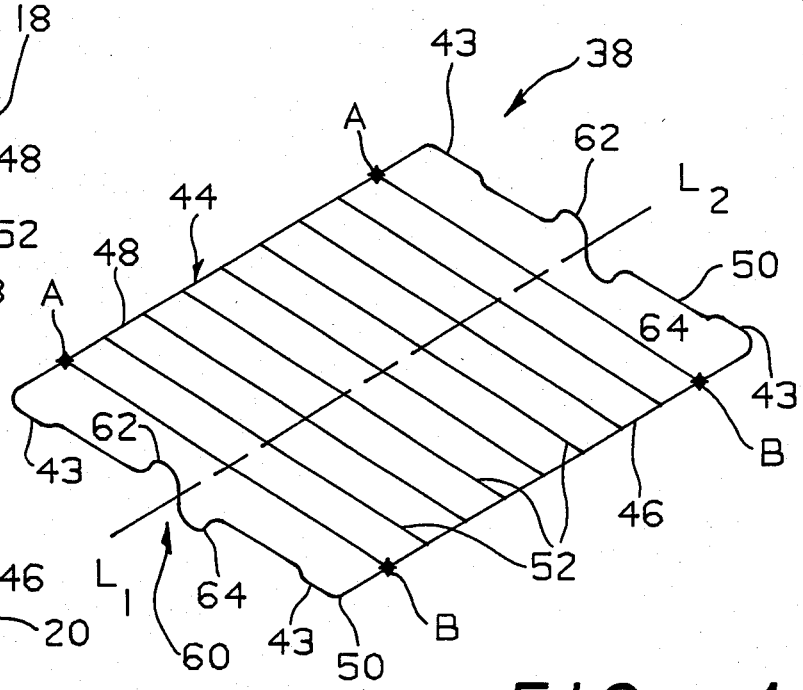
FIG. 6 is a perspective view of the present rack.

In order to provide necessary support for foods to be cooked in the oven 13, there is provided a metal cooking shelf or rack generally designated by numeral 38 which is adapted to be supported horizontally at selected levels relative to the bottom wall 20. To this end there are secured to side walls 14 and 16 an upper set of rack support members 40 and a lower set of rack support members 42. Each of the set of support members 40 and 42 comprise a pair including forward and rear supports on each of the side walls 14 and 16. In the presently preferred form of the invention the rack 38 is of a wire rack type but it is to be understood that other types of metal shelves may be utilized if desired. The rack 38 as shown in FIG. 6 includes a peripheral support wire 44 which includes front and rear portions 46 and 48 and side portions 50. The support surface of the rack 38 is in a plane defined by a plurality of wire members 52 mounted in parallel relation to each other and side portion 50 but perpendicular to the front rear portions 46 and 48 of the peripheral wire 44. The wire members 52 are welded together at their various intersections with portions 46 and 48 so as to provide a rigid rack structure. The present rack as shown is designed so as to prevent its overheating in the presence of the high energy microwave field. To this end the rack components are arranged in relationship to the conductor path length at the operating microwave frequency of the oven. For example, the length of the side portions 50 as measured between points A-B is designed to be an integral number of one half ($\frac{1}{2}$) wave lengths, while the space between the wire members at the junction with front and rear members 46 and 48 is generally odd numbers of one quarter ($\frac{1}{4}$) wave lengths.

It will be observed that the general configuration of shelf 38 as defined by support wire 44 is similar to the configuration of bottom wall 20, but that shelf 38 is somewhat smaller so as to provide air gap between the edges of the rack 38 as defined by wire 44 and the side walls of the oven 13 adjacent thereto. It is necessary that there be no electrical contact between the edges of the shelf and the adjacent side walls and also that these parts be spaced as described so as avoid detrimental distortion of the microwave field patterns in the oven and arcing between the rack and the metal side walls of the oven.

Figure 3:
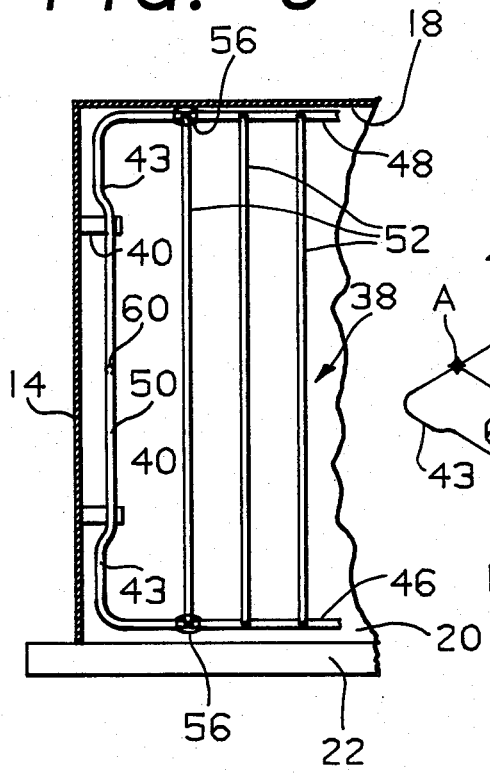
FIG. 3 is a plan view taken along line 3—3 of FIG. 1.

Means are provided in the present rack construction to insure that clearance is maintained between the rack and oven walls. To this end as shown in FIG. 1 the rack support members 40 and 42 are formed to include a groove or channel portion 54 which is dimensioned to receive the side portions 50 of wire 44. This arrangement secures the rack 38 against movement of the rack relative to the oven side walls 14 and 16. As best seen in FIGS. 3 and 6, to prevent front to rear movement of the rack the side portion 50 fore and aft of each pair of the support members 40, 42 are formed to include portions 43 which extend outwardly toward the side walls 14 and 16 respectively. In effect the axis of portions 43 are out of axial alignment with the segment of side portions 50 supported in the channel portions 54. This offsetting configuration of the axis of portion 43 of side portions 50 relative to channel 54 prevents forward or rearward movement of the rack 38 relative to the oven cavity. The exact radial position of the offset 43 is not critical to provide indexing of the rack, and in fact it is only necessary that the offset be aligned to engage the associated support members. Further, the offset may be arranged between their associated pair of support members. To further prevent contact between the rack 38 and the oven side walls the rack is provided insulating spacers 56. Two spacers 56 are positioned at spaced intervals along the front and rear portions 46 and 48 of wire 44 so as to provide spacing between the rear wall 18 and the rack 38.

The rack configuration as shown is designed to be used in either of two designated locations that is positioned in the upper supports 40 as shown or alternatively on the lower supports 42. Food may be placed on the rack positioned on either set of supports and additionally on the bottom wall 20. In some instances, due to the size and shape of the food to be cooked, the rack will interfere with the placement of the food. In which case the rack must be removed from the oven, since, as mentioned above, it is designed to be effective and free of arcing and distortion of the electric and magnetic field patterns only when used in its designated locations. This potential for distortion and arcing would be present for example if the rack were allowed to be positioned on the bottom wall 20 and food placed on it in that location.

Figure 4:
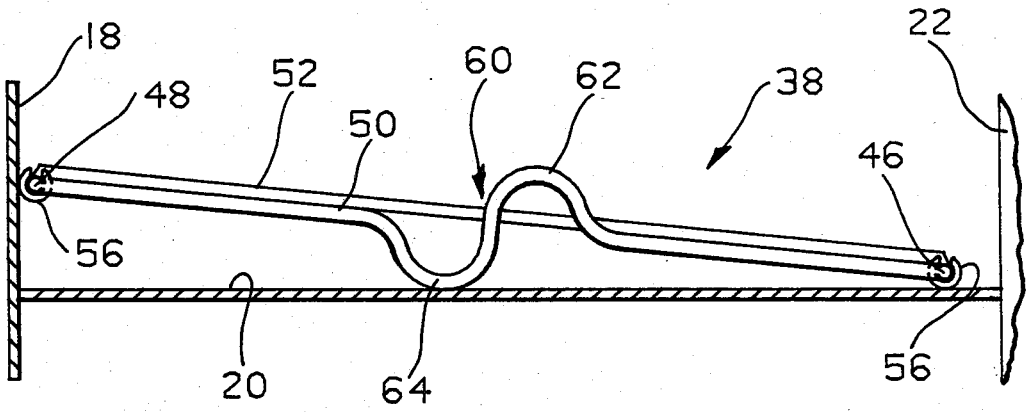
FIGS. 4 and 5 are side views of the rack of the present invention positioned on the bottom wall so as to discourage its use.
Figure 5:
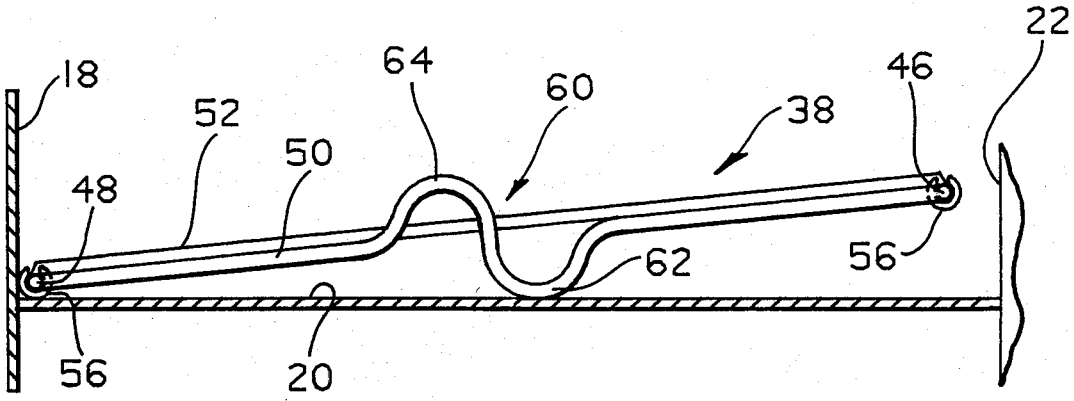

Accordingly, by the present invention means are provided for discouraging use of the rack when it is placed on a relatively flat surface such as bottom wall 20. To this end, each of the side portions 50 of wire 44 are formed with a serpentine section 60. The serpentine section 60 provides a first pair of projections 62 which, as shown in FIGS. 6 and 4, extend upwardly relative to a plane defined by the support wires 52 and a second pair of projections 64 which extend downwardly relative to the plane defined by the support wires 52. In effect the projections 62 are positioned as shown in FIG. 6 on one side of a line L′—L′ dividing the rack 38 between a forward and rear portion and the projections 64 are positioned on the other side of the line dividing the rack between the forward and rear portions. The exact front to rear locations of the projections 62, 64 are not critical; however, their location as shown adjacent the dividing line L′—L′ creates the most unstable configuration in that the rack is more susceptable to rocking action when the pivot is closest to the center of the rack since this is the area in which food would most likely be placed. As seen in FIGS. 4 and 5, the rack 38 when placed on a relatively flat surface such as the bottom wall 20 will pivot about one pair of the projections and tilt at a steep angle. This angle of the support surface of the rack and the location of the projections relative to the dividing line makes the rack rather unstable in that food, depending on its placement relative to the dividing line on the support wires will tend to cause the rack to rock or pivot about the projections contacting wall 20.

While in the embodiment shown the projections were provided by formed a serpentine section in the side portions 50, it should be noted that the projections 62 and 64 may be provided by welding extending members or legs to the side portions 50. One critical design consideration in providing the projections is to insure that the integrity of the conductive path length and operating microwave frequency of the oven be maintained.

In summary, in the present embodiment when the projection 64 as shown in FIG. 4 contacts the bottom wall 20, portion 46 will always rest on the bottom wall 20 either as shown adjacent the door 22 or alternatively adjacent the rear wall 18. If the rack was turned over so that projection 62 contacted the bottom wall 20 as shown in FIG. 5, then portion 48 will always rest on the bottom wall 20 either adjacent the rear wall 18 or alternatively adjacent the door 22. By this configuration a cooking rack is provided by the present invention when it is made unstable and accordingly its use discouraged when an attempt is made to use the oven with the rack so positioned on the bottom wall 20 of the oven.

It should be apparent to those skilled in the art that the embodiment described heretofore is considered to be the presently preferred form of this invention. In accordance with the Patent Statues, changes may be made in the disclosed apparatus and the manner in which it is used without actually departing from the true spirit and scope of this invention.

What is claimed is:

1. A microwave oven cooking rack construction adapted to be supported in a substantially horizontal position in spaced parallel relationship above the bottom wall of said oven comprising:

a support surface defining a plane on said rack including front, rear and side edge portions;

each of said side edges being provided with a pair of projections, one of each pair of projections extends upwardly and the other one of each pair of projections extends downwardly relative to the plane of said rack, said one of each pair of said projections being positioned forwardly and said other one of each pair of said projections positioned rearwardly of a line dividing said rack between a fore and aft portion, whereby in the event said rack is placed on said bottom wall either said one or said other one of each pair of projections will contact said bottom wall and cause said rack to pivot thereabout so that said support surface defining said plane will lay at an angle relative to said substantially flat bottom wall to thereby prevent inadvertent use of said rack when it is positioned on said bottom wall.

2. The rack construction recited in claim 1 wherein said front, rear and side edge portions of said rack is a continuous rod-like member having a rectangular configuration.

3. The rack construction recited in claim 2 wherein each of said pair of projections are continuously formed serpentine portion on the side edge portion of said continuous rod-like member.

4. The rack construction recited in claim 3 wherein said line dividing said rack bisects said rack.

5. The rack construction recited in claim 4 wherein each pair of projections are mirror images.

6. A cooking rack construction in combination with a microwave oven comprising a compartment having a substantially horizontal bottom wall, a rear wall and side walls comprising:

said rack including a support surface defining a plane supported on front, rear and side edge portions;

said side walls provided with fore and aft extending supports on which said side edge portions of said rack are seatable;

said side edges of said rack being formed to include indexing means for engaging said extending supports on said side wall for positioning said rack relative to said oven walls;

each of said side edges being provided with a pair of projections, one of each pair of projections extends upwardly and the other one of each pair of projections extends downwardly relative to the plane of said rack, said one of each pair of said projections being positioned forwardly and said other one of each pair of said projections positioned rearwardly of a line dividing said rack between a fore and aft portion, whereby in the event said rack is placed on said bottom wall either said one or said other one of each pair of projections will contact said bottom wall and cause said rack to pivot thereabout so that said support surface defining said plane will lay at an angle relative to said substantially horizontal bottom wall to thereby prevent inadvertent use of said rack when it is positioned on said bottom wall.

7. The rack construction in combination with a microwave oven recited in claim 6 wherein said front, rear and side edge portions of said rack is a continuous rod-like member having a rectangular configuration similar to said bottom wall but smaller so that the edge portions thereof are spaced from said rear and side walls.

8. The rack construction in combination with a microwave oven recited in claim 7 wherein said fore and aft extending supports are of an insulating material and further insulating means are positioned on the rear edge portion of said rack to prevent contact between said rack and oven walls.

9. The rack construction in combination with a microwave oven recited in claim 8 wherein each of said pair of projections are continuously formed serpentine portion on the side edge portion of said continuous rod-like member.

10. The rack construction in combination with a microwave oven recited in claim 9 wherein said oven further includes means for introducing microwave energy of a predetermined wave length into said oven.

11. The rack construction in combination with a microwave oven recited in claim 10 wherein said support surface further includes a plurality of elongated rods disposed in spaced parallel relation to said side edge portions with said spacing between said rods being an odd number of $\frac{1}{4}$ of said wave length.

12. The rack construction in combination with a microwave oven recited in claim 11 wherein said side edge portions including said pair of projections extending between the ends of adjacent elongated rods is an integral number of $\frac{1}{2}$ of said wave lengths.

13. The rack construction in combination with a microwave oven recited in claim 12 wherein said line dividing said rack bisects said rack.

14. The rack construction in combination with a microwave oven recited in claim 13 wherein each pair of projections are mirror images.

* * * * *